US006432029B1

(12) United States Patent
Almeda

(10) Patent No.: US 6,432,029 B1
(45) Date of Patent: Aug. 13, 2002

(54) EXERCISE ASSEMBLY

(76) Inventor: Thomas M. Almeda, 14 Aster Terrace, Key West, FL (US) 33040

( * ) Notice: Subject to any disclaimer, the term of this patent is extended or adjusted under 35 U.S.C. 154(b) by 0 days.

(21) Appl. No.: 09/450,172

(22) Filed: Nov. 29, 1999

Related U.S. Application Data

(60) Provisional application No. 60/110,375, filed on Nov. 30, 1998.

(51) Int. Cl.[7] ..... A63B 26/00; A63B 71/00

(52) U.S. Cl. ..... 482/140; 482/142; 482/907; 482/91

(58) Field of Search ..... 482/140, 142, 482/907, 10, 120, 91

(56) References Cited

U.S. PATENT DOCUMENTS

| | | | | |
|---|---|---|---|---|
| 4,079,933 A | | 3/1978 | Everroad | |
| 4,863,158 A | * | 9/1989 | Tassone | 482/140 |
| 5,248,287 A | | 9/1993 | Nicoletti | |
| 5,372,566 A | | 12/1994 | Olschansky et al. | |
| 5,413,548 A | | 5/1995 | Hoffman | |
| 5,580,342 A | * | 12/1996 | Johnson | 482/105 |
| 5,637,067 A | | 6/1997 | Ausmus | |
| 5,681,248 A | | 10/1997 | Vani | |
| 5,792,035 A | * | 8/1998 | Ward et al. | 482/140 |

* cited by examiner

*Primary Examiner*—Michael A. Brown
*Assistant Examiner*—Lori Baker Amerson
(74) *Attorney, Agent, or Firm*—Malloy & Malloy, P.A.

(57) ABSTRACT

An exercise assembly designed to strengthen and stretch predetermined portions of a user's body including but not limited to the muscle group of the abdominal area, the spinal column, and the neck particularly in the area of the cervical vertebrae. The exercise assembly includes a base portion defined by a neck engaging portion and two spaced apart shoulder engaging members mounted in overlying relation to the shoulders and on opposite sides of the neck. Two arm members extend outwardly in a forward direction relative to the orientation of the assembly on a user's body and are structured to be gripped at an outer portion by the hands of the user wherein a lifting force is exerted on the neck during the performance of a variety of specifically defined exercises by a pulling force being exerted on the arm members by the user. Auxiliary weights may be removably attached to the base portion in cooperation with the neck engaging portion so as to provide additional resistance when the user is performing various ones of the prescribed exercises and in particular those exercises directed to the strengthening of the abdominal muscles.

23 Claims, 4 Drawing Sheets

EXERCISE ASSEMBLY

CLAIM OF PRIORITY

The present application is based on and a claim to priority is made under 35 U.S.C. Section 119 (e) to provisional patent application currently pending in the U.S. Patent and Trademark Office having Ser. No. 60/110,375 and a filing date of Nov. 30, 1998.

BACKGROUND OF THE INVENTION

1. Field of the Invention

The present invention is directed to an exercise assembly designed to strengthen and/or stretch certain portions of a user's body including the muscle group of the abdominal area as well as the spine, neck, etc. The assembly facilitates moveable support of the head while eliminating harmful stress on the neck of the user during the performance of certain exercises, while being maintained out of engagement with any supporting surface on which the user is positioned. The exercise assembly can, therefore, be used with a variety of horizontal or inclined exercise benches to further facilitate strengthening and stretching of the user's body.

2. Description of the Related Art

It is now well understood that stretching and exercising are both important and beneficial to the well being of the human body. In recent years, it has become evident that when some form of regular exercise is incorporated into a person's daily routine, along with a healthy diet, it helps that person maintain a positive outlook, lead an active lifestyle and avoid many of the physical problems typically associated with old age. As a result, numerous devices intended to facilitate the performance of a variety of exercises have been developed in recent years. Some of the known devices are designed to provide a user with a cardiovascular workout, while others offer resistance types of exercise. Yet other exercise devices allow the user to isolate a particular muscle group such as the leg muscles or abdominal muscles and focus on exercising that particular muscle group. Because of the normal tendency of many people to build-up fatty deposits about the stomach and/or abdominal areas, particularly in people who do not exercise regularly, numerous exercise devices have been developed which are specifically intended to allow one to exercise and/or strengthen the abdominal muscle group. Many of these devices are commercially available in an effort to appeal to those members of the consuming public wishing to remove or reduce the accumulation of fatty deposits around the waist area.

Many such devices are designed to facilitate the performance of an exercise commonly known as "sit-ups". People avoid these important exercises because of the strenuous effect on the neck muscles, which can be uncomfortable, and even painful at times. Such exercises, if not done properly, can cause undue stress and possibly trauma, particularly to the lower back region, and can also result in the abdominal or waist area of the body not being properly exercised. While numerous devices have been designed to perform this type of exercise, one common device involves a frame-like structure disposed in supporting relation to the head and upper body or torso region of a user, when the user is disposed in a substantially reclined, horizontal position on the floor or other supporting surface. This type of exercise frame also engages the floor or other supporting surface and is structured to "roll," pivot or otherwise move relative thereto, as the user performs the "sit-up" type exercise by exerting a downwardly directed, pulling force on the device. Of course, it is intended that the pulling force applied to the device result in a lifting force being exerted on the back of the head or neck area of the user. However, due to the fact that this known type of a support frame contacts the floor or like supporting surface on which the user is positioned in a rolling manner, the intended sit-up type exercise is frequently not done properly. Exercise devices of this type are structured to rest on the floor, ground, or other supporting surface, using the supporting surface as a "fulcrum point," and can therefore be said to have a "see-saw" effect. That is, when the user exerting the pulling force by pulling down with the arms, an opposite force in an upward direction is applied to that portion of the device which contacts the head, neck and upper torso, which serves to move these parts of the body upwardly as well. However, this upwardly directed force creates stress and a potentially harmful force on the neck and upper back of the user, and further, gives a false sense of strength to the user. In reality, devices of the type described above are structured such that most of the resistance force is being absorbed by the device itself and not by the user's abdominal muscles, and this gives the user a false sense of achievement. Therefore, the exercises are not performed as intended, nor as required to strengthen the abdominal muscle group nor to reduce the fat deposits that may be accumulated thereon. Devices of this type, which engage the floor or like supporting surface on which the user is positioned and which generally use the supporting surface as a "fulcrum point," thereby encourage the user unknowingly to perform the intended exercises in an improper manner.

Other exercising or strengthening devices have been devised in an attempt to overcome some of the problems associated with the aforementioned, "roller type" of exercise device. Such known devices include flexible material straps that have a support padding or like structure positionable in supporting engagement with the back of the head or neck area of the user. With these types of devices, the user pulls on the opposite ends of the strap to help lift the neck and head in an upward direction, in an effort to accomplish a properly performed sit-up exercise. There are still other types of known devices intended to exercise the abdominal muscles, which allow for the mounting of weights thereon, so as to increase the resistance applied to the abdominal muscle group when the sit-up exercises are being performed. This is done in an attempt to even further strengthen or otherwise develop the abdominal area or other predetermined portions of the user's body being exercised.

In light of the inherent disadvantages associated with certain known exercise devices, there is a need in the art for an exercise assembly that is specifically designed to exercise, by strengthening and/or stretching, certain portions of the user's body, such as the abdominal area, the neck area, the back and cervical spine area, as well as other portions of the user's body. Any such assembly should be designed and structured to be mounted on or applied to the user's body in a manner which prevents the device from contacting the ground, floor or other support surface on which the user is positioned, during the performance of the exercise movements. Any such improved device should, as its primary function, at least aid with supporting the weight of the head during the "sit-up" or abdominal crunch exercise, a function normally carried out by the neck muscles of the user. With any such improved exercise device, potentially harmful stress to the neck should thereby be greatly reduced, if not eliminated, and in turn, a user of the device can isolate for exercise the abdominal muscle group, only, during the performance of "sit-ups" or related stretching exercises. In addition, any such exercise assembly should further be structured and designed so as to allow the user to properly perform a variety of different exercises in a manner which will minimize, if not eliminate altogether, potentially harmful stress forces that may be exerted on the body particularly in the area, but not exclusively, of the neck.

SUMMARY OF THE INVENTION

The present invention is directed to an exercise assembly that is designed to strengthen and/or stretch predetermined portions of a user's body, such as but not limited to, the muscle group of the abdominal area. An important feature of the present invention, when doing exercises designed to strengthen the abdominal area is to aid, at a minimum, the user's neck muscles in supporting the weight of the head during the performance of exercises such as "sit-ups" or abdominal "crunches." As a result, stress on the neck muscles is greatly reduced, if not eliminated, and the user may therefore focus solely on the strengthening of the abdominal muscle group. Alternatively, the exercise assembly is structured so as to facilitate the stretching of the spinal column and the muscles associated therewith, and in particular, the cervical area of the spine, thereby allowing users of the exercise assembly to accomplish and maintain a desired amount of body flexibility.

Another important feature of the present invention is the mounting of the exercise assembly on a user, during the performance of certain intended or prescribed exercises, in a manner which will allow the user to be positioned on the ground, on a floor or a like supporting surface, or on a horizontal or inclined exercise board, or on an inventive exercise device of the type disclosed in my U.S. Pat. Nos. Des. 353,173; 5,584,786; 5,795,276; all of which are incorporated herein by reference. The user of the exercise assembly of the present invention thereby, has the benefit of increased versatility and ability to perform intended exercise movements in a correct manner, in that the exercise assembly of the present invention does not come into contact or engagement with the ground, floor, or other support surface or structure on which the user is positioned.

More specifically, the exercise assembly of the present invention comprises a base portion including a neck engaging portion and a shoulder engaging portion connected to the neck engaging portion. The shoulder engaging portion includes two shoulder members spaced from one another and extending outwardly from the neck engaging portion. In a preferred embodiment, the neck engaging portion and the shoulder engaging portion collectively define a somewhat U-shaped configuration which, when positioned on the user during the performance of an exercise, is disposed in generally surrounding relation to the neck and/or lower head portion.

In the preferred embodiment, the exercise assembly of the present invention further comprises two arm members connected to an extending outwardly from a free or distal end of different ones of the aforementioned shoulder members. Each of the arm members are of a substantially equivalent length and extend outwardly in a forward direction from the user of the assembly when mounted thereon in the intended fashion. In a more preferred embodiment, the arm members are oriented in substantially angularly divergent relation to one another so as to extend forwardly and laterally from the body of the user. This orientation of the arm members prevents inadvertent and undesirable contact with the legs or lower portion of the user's body, particularly when the user is performing a sit-up type of exercise. The length of the arm members are such as to facilitate gripping by the user along the length thereof, preferably at the outermost ends thereof, so that the user may exert a downwardly directed pulling force thereon. This pulling force is transmitted to the base portion, and preferably, the neck engaging portion, such that an upwardly directed lifting force is exerted. Proper movement and positioning of the head and neck areas of the user's body is thereby reasonably assured, dependent upon the exercise being performed, without placing unnecessary and potentially harmful stress thereon.

As set forth above, the exercise assembly of the present invention does not contact the ground, floor or other supporting surface on which the user is positioned during the exertion of the aforementioned pulling force by the user on the exercise assembly. Accordingly, utilization of the exercise assembly according to the present invention is believed to overcomes certain disadvantages associated with known and/or commercially available exercise devices of the type which engage the ground, floor or other supporting surface on which the user is positioned and use it as a "fulcrum point" as the user moves through "sit up" exercises. To the contrary, the exercise assembly of the present invention rests at least in part on the user's body, and is out of contact or engagement with the floor or other supporting surface on which the user is positioned. It is believed that the exercise device of the present invention represents a significant step forward in the art by supporting the head of the user during the performance of abdominal exercises without directing any undue stress to the neck area of the user. Further, mounting or positioning of the exercise device of the present invention on the user, in a manner to be described in greater detail hereinafter, makes it difficult, if not impossible, to lift the user's body except through the almost exclusive use of the power or strength derived from his or her abdominal muscle group, which presents the user with a more accurate measure of his or her strength and achievement.

Other features associated with the exercise assembly of the present invention may include the provision of cushion means which, in certain preferred embodiments may include a headrest. In other embodiments, the cushion assembly may include a plurality of cushion segments located on the neck engaging portion, as well as on the shoulder members so as to facilitate comfortable mounting or engagement of the exercise assembly of the present invention in a proper orientation on the user's body during the performance of exercise.

Yet other structural features of certain preferred embodiments of the present invention include the ability to selectively orient or position the exercise assembly in a compacted, stored position, wherein the exercise assembly takes up considerably less volume, for purposes of storage or travel, when the exercise assembly is not being used.

It is a primary object of the present invention to provide an exercise assembly designed to strengthen, stretch and/or otherwise exercise predetermined portions of the user's body such as, but not limited, to the muscle groups of the abdominal area, the spinal column area and the cervical area of the spine.

Another primary object of the present invention is to provide an exercise assembly which, when oriented in an operative position on the user's body, does not engage or contact the ground, floor or other supporting surface during the performance of a variety of exercises being conducted by a user.

Yet another primary object of the present invention is to provide an exercise assembly for performing abdominal type exercises in a manner which concentrates the focal point on the user's body thereby removably supporting the user's head during the performance of such exercises without directing any stress or potentially harmful force to the neck of the user.

Yet another important object of the present invention is to provide an exercise assembly which is formed of a high strength, durable, yet lightweight material so as to be properly oriented on the user's body in a manner which does not injure or provide undue stress to the user during the performance of exercises.

Still another important object of the present invention is to provide an exercise assembly designed and structured to allow for the removable attachment of one or more weights thereto, so as to increase the resistance force exerted on predetermined portions of the user's body during the performance of certain exercises.

It is also an important object of the present invention to provide an exercise assembly designed and structured to be selectively positioned or oriented in either an operative configuration for mounting on the user's body or a compacted position for storage or carrying thereof.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
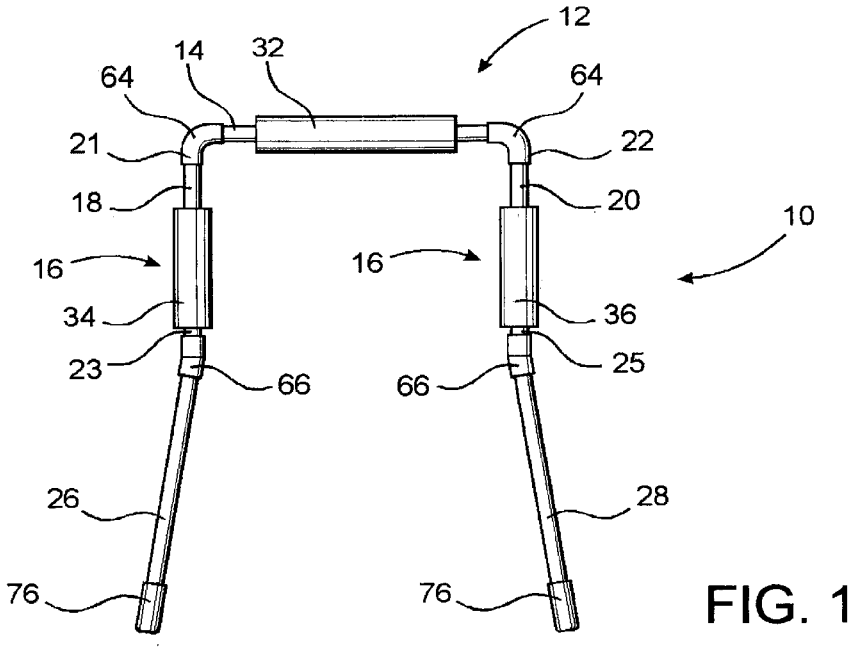
FIG. 1 is a front or top plan view of the exercise assembly of the present invention.
Figure 2:
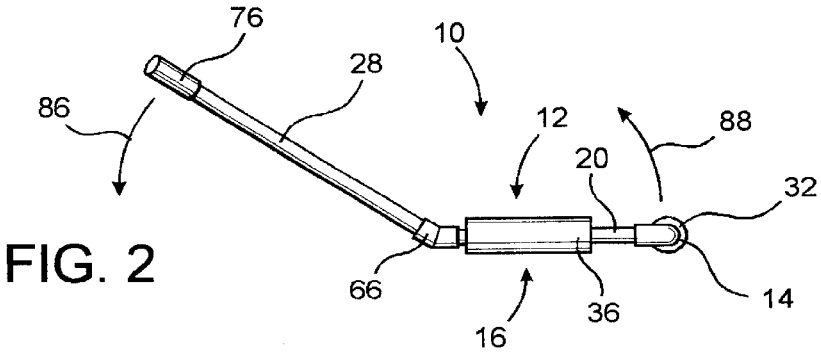
FIG. 2 is a side view of the embodiment of FIG. 1.

As shown in the accompanying drawings, the present invention is directed to an exercise assembly, which in a preferred embodiment, is generally indicated as 10 in FIGS. 1 and 2. The exercise assembly 10 includes a base portion, generally indicated as 12, which preferably is defined by a neck engagement portion 14 and a shoulder engaging portion 16. The shoulder engaging portion 16 preferably includes two spaced apart shoulder members, as at 18 and 20, with each having a proximal end, as at 21 and 22 respectively, that is either directly connected to or operably coupled to the neck engaging portion 14. In addition, each of the shoulder members 18 and 20 includes a distal end, as at 23 and 25, connected to two arm members 26 and 28.

As clearly shown in FIGS. 1 and 2, the base portion 12 is preferably designed to assume a generally "U" shaped configuration, so as to at least partially surround the lower head and/or neck area of the user 50. When properly oriented on the user, the neck engaging portion 14 is disposed in supporting engagement with the lower head and/or neck area, and the shoulder members 18 and 20 are disposed on opposite sides of the head of the user and in overlying engagement with the correspondingly positioned shoulders. In order to add comfort and encourage proper positioning and utilization of the exercise assembly 10, the base portion 12 preferably includes a cushioning means, which may be defined by (but which is not limited to) cushion segments 32, 34 and 36 mounted on the neck engaging portion 14, and on each of the shoulder members 18 and 20, respectively. Each of the cushion segments 32, 34 and 36 may be formed from a foam, sponge rubber or other resilient material which engages the various intended portions of the user's body and provides a resilient, flexible contact point which, at least to a certain extent, absorbs certain forces placed on the user's body during the conducting of predetermined exercises.

In the preferred embodiment of FIGS. 1 and 2, as well as the other preferred embodiments to be described in greater detail hereinafter, the neck engaging portion 14, both shoulder members 18 and 20, and both arm members 26 and 28 are preferably formed of an elongated, high strength, durable, yet lightweight material which is substantially rigid, but which may demonstrate a certain minimum amount of flexibility in order to reduce unnecessary stress to the user's body during the performance of certain exercises. A suitable material might be polyvinyl chloride or similar PVC tubing for ease of assembly at a minimal cost.

In a more preferred embodiment of the present invention, the arm members 26 and 28 are further oriented in an outward direction from the base portion 12, such that they extend substantially forwardly from the user. Even more preferably, the arm portions 26 and 28 will be structured to be oriented angularly outward from one another in a substantially divergent relationship as can be discerned from FIG. 1. Therefore, when properly oriented on the user's body, the arms 26 and 28 extend outwardly, preferably forwardly and laterally from each corresponding side of the user's body. This laterally, angularly divergent orientation of the arms 26 and 28, as best shown in FIG. 1, prevents the arm members from inadvertently and unintentionally coming into contact with lower torso and/or the leg portions of the user's body, such as when the user is performing a sit-up type exercise.

Figure 4:
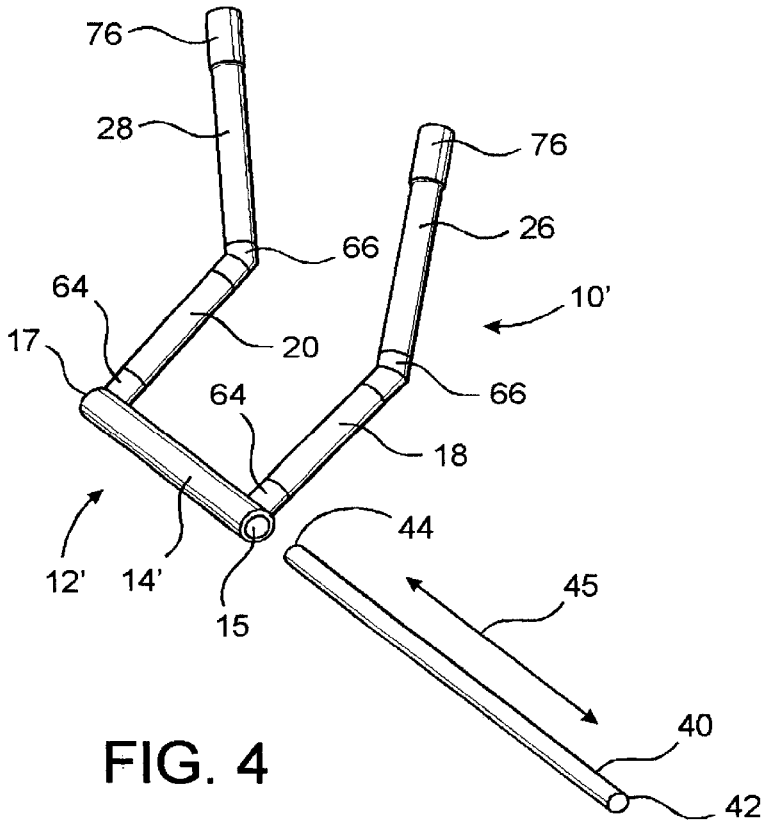
FIG. 4 is a perspective view in partially exploded form of another preferred embodiment of the present invention.
Figure 5:
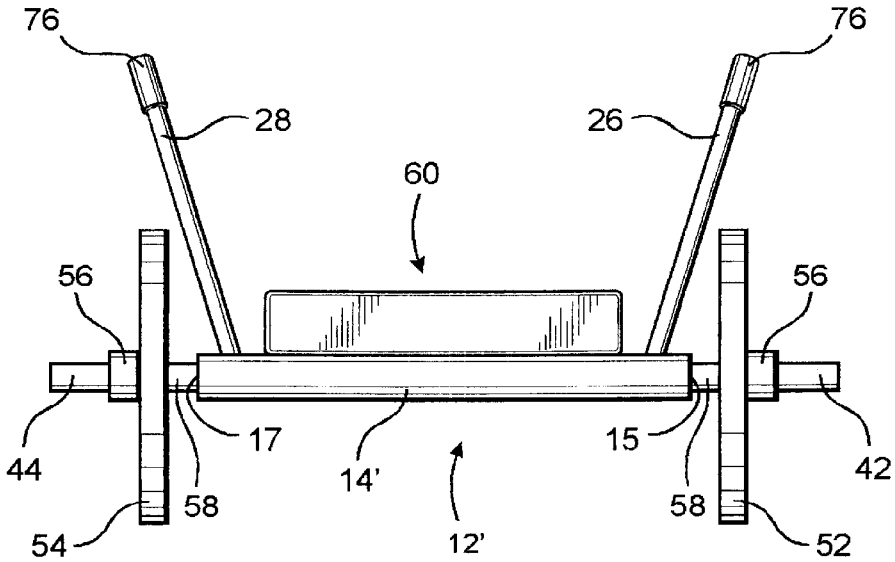
FIG. 5 is a rear view of yet another preferred embodiment of the present invention.

With regard to FIGS. 4 and 5, yet another preferred embodiment of the present invention is illustrated wherein at least the base portion 12' defined by the neck engaging portion 14' has an elongated, substantially hollow configuration along its length, and further, wherein the neck engaging portion 14 terminates at oppositely disposed open ends, 15 and 17. In this embodiment, a user of the device has the benefit of versatility in that an additional resistance force might be added through the removable attachment of an elongated support member, as at 40, to the base portion 12'. Support member 40 has a transverse dimension sufficient to pass within the interior of the hollow, neck engaging portion 14' and through the open ends 15 and 17 thereof. In addition, the length of the support member 40 is such as to have its opposite ends, as at 42 and 44, protrude a significant distance outwardly from the respective open ends 15 and 17 of the neck engaging portion 14'. The sliding motion of the support member 40 both into and out of the interior of the neck engaging portion 14' is demonstrated by the directional arrow 45 of FIG. 4. When properly oriented as shown in FIG. 5, the support member 40 is structured and disposed to have one or more weight elements, as at 52 and 54, removably mounted on opposite ends thereof, as at 42 and 44. The weight elements 52 and 54 may take the form of any number of conventional structures and designs, preferably of the type that has a central aperture sized to receive the respective ends 42 and 44 of the support member 40 therethrough. In addition, the weight structures 52 and 54 may be maintained in a fixed but removable position on support member 40 by means of clamping and/or retaining collars 56 and 58.

Figure 6:
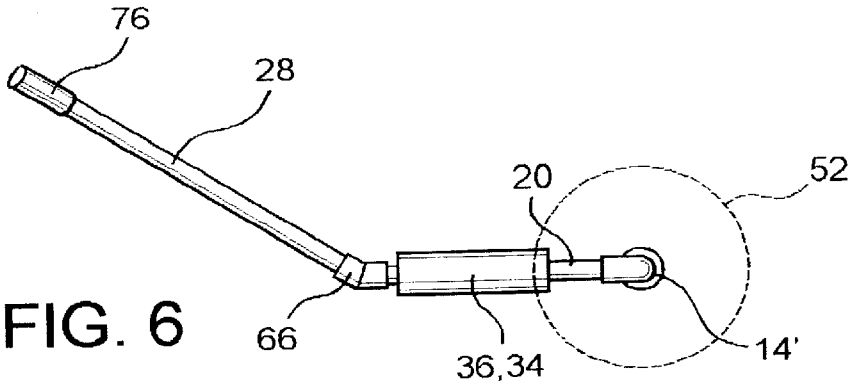
FIG. 6 is a side view of the embodiment of FIG. 4.

The embodiments of FIGS. 4, 5 and 6 also may include cushion means, which may be defined by cushion segments 36 and 34, see FIG. 6, as well as a modified cushion segment, which is generally indicated as 60, in the form of a headrest. The headrest is also formed of a foam or sponge-like material and is sufficiently resilient or flexible to adequately support the back of the head of the user during the performance of certain exercises. It should be emphasized however, that in the performances of certain predetermined exercises, it may be desirable to eliminate the headrest 60 since a lifting force exerted on the head or neck of the user may be self-defeating. More specifically, the presence of a headrest may induce the user to perform certain stretching and/or strengthening exercises in an incorrect manner.

Another inventive feature of the various preferred embodiments of the present invention is the increased versatility in allowing a user to selectively arrange the various components thereof, in either an operative position for use or a compacted position for storage and travel. The operative position is clearly demonstrated in FIGS. 1, 2, 4, 5 and 6. However, referring to those FIGURES, the neck engaging portion 14, shoulder members 18 and 20, and arm members 26 and 28, may be interconnected to one another by fixed, at least partially hollow, angularly oriented elbow joints as at 64 and 66. These elbow joints, depending upon the particular components which they serve to interconnect, may be configured to assume a different angular orientation. For example, the neck engaging portion 14 and the shoulder members 18 and 20 are attached by elbow joints 64 and are preferably oriented in transverse, substantially perpendicular relation to one another. However, the elbow joints 66 have a somewhat lesser angular orientation to provide the outwardly, angularly divergent orientation of the arm members 26 and 28 relative to the shoulder members 18 and 20. In any event, each of various components including the neck engaging portion 14, shoulder members 18 and 20 and arm members 26 and 28, may be removably attached to one another by separation from the elbow joints 64 and 66 when it is desired to arrange the components in a compacted position for storage and/or travel.

Figure 8:
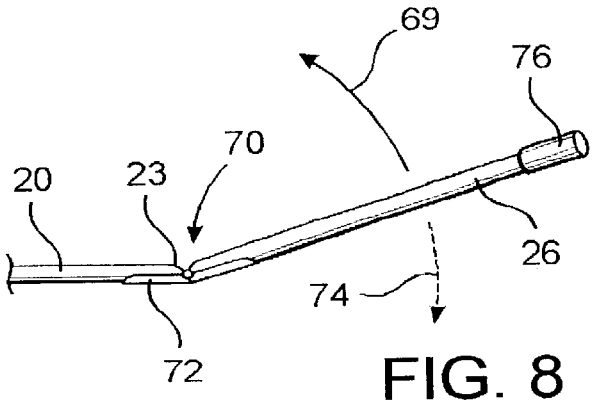
FIG. 8 is a detail side view in partial cutaway showing specific structural features of yet another embodiment of the present invention.
Figure 9:
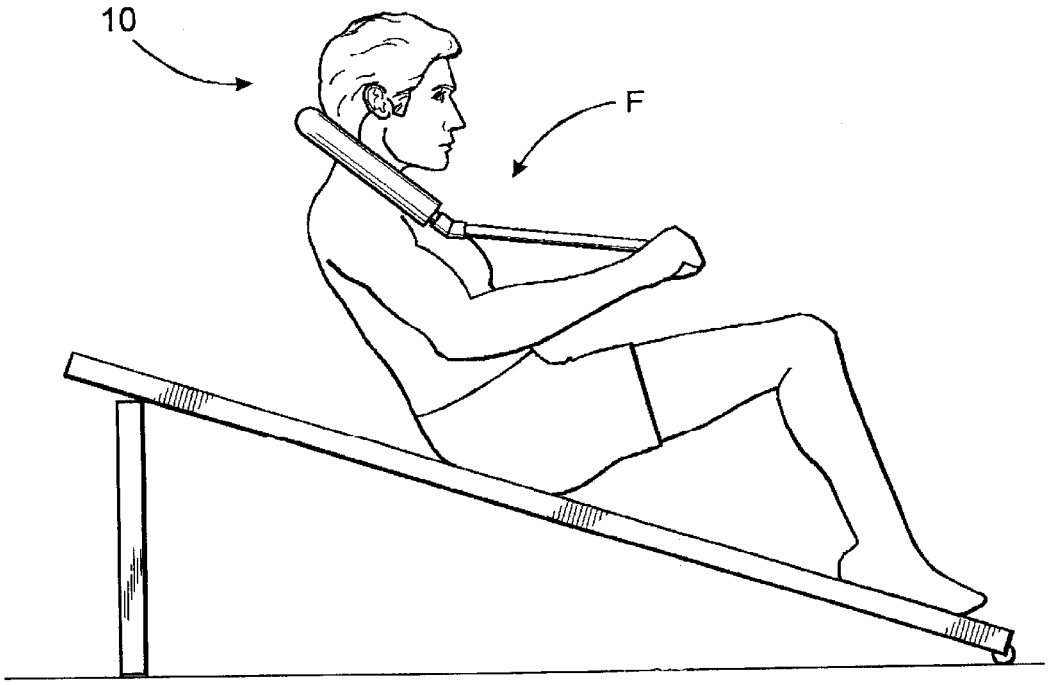
FIG. 9 is a side view showing the fulcrum point of the exercise assembly of the present invention on a user.
Figure 10:
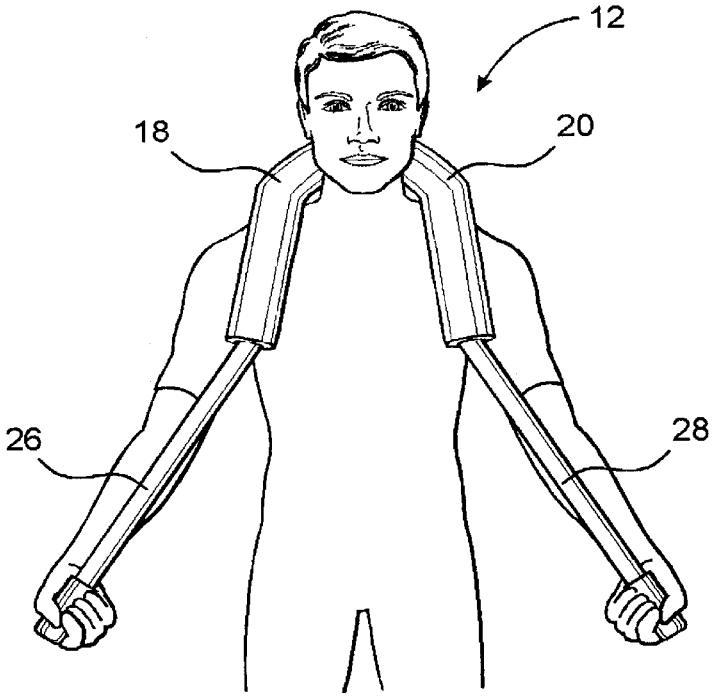
FIG. 10 is a front view of the present invention illustrating the overlying disposition of the exercise assembly between the shoulders of a user.

In another embodiment of the present invention as best shown in FIG. 8, the aforementioned compacted position may be assumed by folding interconnecting ones of the components, such as arm members 26 and 28 relative to the shoulder members 18 and 20 in a direction indicated by directional arrow 69. Such a folding or pivotal interconnection is accomplished by a hinge and/or pivot structure generally indicated as 70 and a fixed, angularly oriented stop member 72 fixedly secured to extend outwardly from the distal end 23 of the shoulder member 20 so as to prevent rotation or further movement of the arm member 26 in the direction indicated by directional arrow 74, represented in phantom in FIG. 8. Therefore, the operative position of each of the arm members is maintained as outlined in detail above, while the compact position may be assumed by selectively folding each of the arms 26 and 28 inwardly in accordance with the directional arrow 69.

Figure 7:
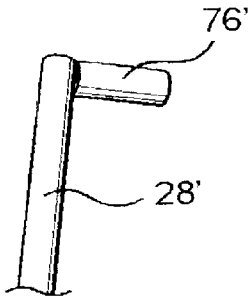
FIG. 7 is a detail view in partial cutaway showing yet another embodiment of the present invention.

Referring now to FIG. 7, the present invention may include a handle or gripping portion 76 which preferably, is oriented in a transverse relation to the length of the arm 28'.

FIG. 7 demonstrates a single arm, 28', with an outwardly extending handle or gripping portion 76, however, in this embodiment both the arms 26 and 28 will include the outwardly extending grip 76. The embodiment of FIG. 7, of course, differs from the embodiments of FIGS. 1 through 6 in that the gripping portions 76' are normally disposed in linearly aligned relation to the length of the arms 26 and 28 as clearly represented.

Figure 3:
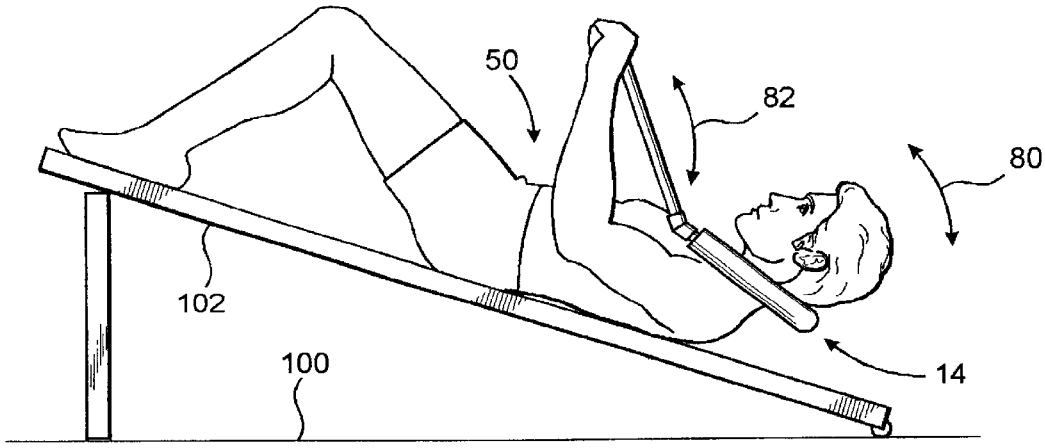
FIG. 3 is a side view in partial schematic form showing one possible position of a user of the exercise assembly of the present invention on an inclined exercise bench, and schematically indicating certain ones of a plurality of strengthening or stretching exercises which may be preformed with the present invention.

With reference to FIG. 3, operation of the exercise assembly of the present invention is demonstrated at least partially in schematic form. More specifically, the neck engaging portion 14 of the base portion 12 is shown properly positioned behind the neck or lower head area of the user 50. When the neck engaging portion 14 is so positioned, the exercise assembly 10 of the present invention may be used, for example, to stretch and thereby, facilitate increased flexibility of the cervical area of the spine by continuously moving the head of the user 50 in accordance with the directional arrow 80. Also, the versatility of the exercise assembly 10 of the present invention is further demonstrated by enabling and facilitating the user 50 to perform exercise and strengthening of the abdominal area of the user's body 50 by performing a sit-up exercise as demonstrated by directional arrow 82. In the performance of either of the exercises as set forth above, the user will exert a pulling force on the arm members 26 and 28 by gripping the arm members 26 and 28 along a length thereof or preferably at the outer end such as by the handle or grip portion 76. The pulling force is exerted in a downward or inward direction as indicated by directional arrow 86 of FIG. 2. Such pulling force in turn results in a lifting force being exerted on the back of the head of the user 50 while eliminating any potentially harmful and painful force and/or stress being applied or directed to the neck of the user, as demonstrated by the directional arrow 88 of FIG. 2.

It is again to be emphasized that the exercise assembly 10 of the present invention is intended not to engage any supporting surface such as the floor or ground surface 100 or a horizontal or included support or exercise bench as at 102, thereby assuring that the lifting force exerted on the back of the head or neck area of the user 50, will be properly placed and serve only to lift the head either during the stretching exercise demonstrated by directional arrow 80 or the abdominal exercise demonstrated by directional arrow 82. Since the exercise assembly 10 of the present invention does not engage the supporting surfaces 100 and/or 102, it will not use such a supporting surface as a "fulcrum point" which effectively defeats the purpose of a sit-up type exercise. To the contrary, the exercise assembly 10 concentrates the focal point or "fulcrum" point on the user's body and in doing so accomplishes a primary purpose of movably supporting the user's head during the performance of abdominal exercises while eliminating any stress to the neck area of the user. This in turn forces the user to lift the body during the performance of the abdominal exercise using primarily, if not exclusively, power or force developed from the abdominal muscle group.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An exercise assembly designed to strengthen and stretch predetermined parts of the user's body, said assembly comprising;

a) a base portion configured to surround and supportingly engage a neck of the user, b) said base portion being configured to extend outwardly from the neck of the user in a forward direction and in overlying disposition to each shoulder of the user, c) two arms connected to said base portion and extending outwardly from the user in a forward direction, d) each of said two arms having an elongated configuration of sufficient length to be gripped by the user at spaced apart positions forwardly and latterly of the user, e) said base portion and said two arms collectively structured to exert a lifting force on the neck of the user when a pulling force is exerted on said two arms, and f) said two arms are movably connected to said base portion and selectively positionable between a compact position and an operative position.

2. An assembly as recited in claim 1 wherein said two arms are disposed in angularly divergent, spaced relation to one another.

3. An assembly as recited in claim 1 wherein said base portion comprises a neck engaging portion disposable in supporting engagement with the neck of the user and a shoulder engaging portion transversely oriented relative to said neck engaging portion and disposable in overlying relation to the shoulders of the user.

4. An assembly as in claim 3 wherein said shoulder engaging portion comprises two elongated spaced apart shoulder members each having a proximal end and a distal end, said proximal end of each shoulder member connected to said neck engaging portion and said distal end of each shoulder member connected to a different one of said two arms.

5. An assembly as recited in claim 4 wherein said two shoulder members are disposed in spaced, substantially parallel relation to one another and in substantially perpendicular relation to said neck engaging portion.

6. An assembly as recited in claim 5 wherein said neck engaging portion comprises a substantially elongated, linear configuration connected to and extending between said proximal ends of said two shoulder members.

7. An assembly as recited in claim 4 wherein said neck engaging portion and said shoulder engaging portion collectively comprises a substantially U-shaped configuration.

8. An assembly as recited in claim 4 wherein said two arms each extend outwardly from a different one of said shoulder members in an angularly upward direction.

9. An assembly as recited in claim 8 wherein said two arms are disposed in angularly divergent, spaced relation to one another.

10. An assembly as recited in claim 1 further comprising cushion means mounted on said base portion for support of said base portion on the user's body.

11. An assembly as recited in claim 1 wherein said two arms are removably connected to said base portion and selectively positionable between a detached position and an operative position.

12. An exercise assembly designed to strengthen and stretch predetermined parts of a user's body, said assembly comprising:

a) a base portion formed of a substantially rigid material including a neck engaging portion configured to at least partially surround and supportingly engage a neck of the user, b) said base portion further including two shoulder members each including a proximal end and a distal end, c) said two shoulder members connected at said proximal ends thereof to said neck engaging portion in spaced relation to one another and being further configured to extend away from the neck of the user in overlying disposition to each shoulder proximate the chest of the user between the user's shoulders, d) said two shoulder members being of sufficient length to be gripped by the user at spaced apart positions forwardly and laterally of the user, e) said base portion and said two shoulder members collectively structured to exert a lifting force on the neck of the user when a pulling force is exerted on said two shoulder members, and f) a support member removably connected to said neck engaging portion and structured to mount a weight structure on said base portion.

13. An assembly as recited in claim 12 wherein said neck engaging portion and said shoulder members are collectively structured to define a substantially U-shaped configuration disposed in at least partially surrounding relation to the user's neck.

14. An assembly as recited in claim 12 wherein said two shoulder members each extend outwardly in an angularly upward direction.

15. An assembly as recited in claim 12 wherein said neck engaging portion comprises an elongated, hollow configuration; said support member having an elongated configuration and a transverse dimension sufficient to be disposed within and along the length of said neck engaging portion.

16. An assembly as recited in claim 15 wherein said support member includes a greater length than said neck engaging portion and is structured to support said weight structure thereon adjacent opposite ends of said neck engaging portion.

17. An assembly as recited in claim 15 wherein said two shoulder members are movably connected to said base portion and selectively positionable between a compact position and an operative position.

18. An assembly as recited in claim 15 wherein said two shoulder members are removably connected to said base portion and selectively positionable between a detached position and an operative position.

19. An assembly as recited in claim 18 wherein said neck engaging portion and said shoulder members are removably connected to one another and selectively positionable between an operative position and a detached position.

20. An exercise assembly designed to strengthen and stretch predetermined parts of a user's body, said assembly comprising:

a) a base portion formed of substantially rigid material including an elongated neck engaging portion configured to at least partially surround and supportingly engage a neck of the user, b) said neck engaging portion comprising a hollow configuration extending along the length thereof, c) said base portion further including two elongated shoulder members each including a proximal end and a distal end, d) said two elongated shoulder members connected at said proximal ends to said neck engaging portion in spaced relation to one another and in transverse relation to said neck engaging portion, said two elongated shoulder members configured to extend outwardly from the neck of the user in a forward direction and in overlying disposition to each shoulder of the user such that said two elongated shoulder members are disposed proximate the chest of the user between the shoulders, e) an arm member formed of rigid material connected to said distal end of each of said two elongated shoulder members, f) said arm members oriented in spaced, angularly divergent relation to one another, g) each of said arm members having an elongated configuration of sufficient length to be gripped by the user at spaced apart positions forwardly and laterally of the user, h) said base portion and said arm members collectively structured to exert a lifting force on the neck of the user when a pulling force is exerted on said arm members, and i) said two shoulder members are movably connected to said base portion and selectively positionable between a compact position and an operative position.

21. An assembly as recited in claim 20 wherein said neck engaging portion and said shoulder members are removably connected to one another and selectively positionable between an operative position and a detached position.

22. An assembly as recited in claim 20 further comprising cushion means mounted on said base portion for support of said base portion on the user's body.

23. An assembly as recited in claim 22 wherein said cushion means comprises a head support extending outwardly from said neck engaging portion and disposable in supporting engagement with a back portion of the user's head.

* * * * *